US005731811A

United States Patent [19]

De Lange et al.

[11] Patent Number: 5,731,811

[45] Date of Patent: Mar. 24, 1998

[54] WINDOW-BASED MEMORY ARCHITECTURE FOR IMAGE COMPILATION

[75] Inventors: Alphonsus A. J. De Lange; Gerard D. La Hei, both of Eindhoven, Netherlands

[73] Assignee: U.S. Philips Corporation, New York, N.Y.

[21] Appl. No.: 847,836

[22] Filed: Apr. 28, 1997

Related U.S. Application Data

[63] Continuation of Ser. No. 483,918, Jun. 7, 1995, abandoned, which is a continuation of Ser. No. 219,129, Mar. 29, 1994, abandoned.

[30] Foreign Application Priority Data

Mar. 29, 1993 [EP] European Pat. Off. ..... 93200895

[51] Int. Cl.[6] ..... G09G 5/00

[52] U.S. Cl. ..... 345/201; 345/185; 345/115; 395/508

[58] Field of Search ..... 345/185, 187, 345/188, 189, 190, 200, 201, 118, 119, 120; 395/115, 507, 508, 521

[56] References Cited

U.S. PATENT DOCUMENTS

| | | | |
|---|---|---|---|
| 4,121,283 | 10/1978 | Walker | 345/119 |
| 4,434,502 | 2/1984 | Arakawa et al. | 382/222 |
| 4,682,215 | 7/1987 | Adachi | 358/539 |
| 4,894,646 | 1/1990 | Ryman | 345/201 |
| 5,068,650 | 11/1991 | Fernandez et al. | 345/301 |
| 5,168,270 | 12/1992 | Masumori et al. | 345/100 |

FOREIGN PATENT DOCUMENTS

| | | |
|---|---|---|
| 0192139 | 8/1986 | European Pat. Off. . |
| 0454414 | 10/1991 | European Pat. Off. . |
| WO 90/09018 | 8/1990 | WIPO . |

*Primary Examiner*—Dennis-Doon Chow

*Attorney, Agent, or Firm*—Anne E. Barschall

[57] ABSTRACT

An image processing system combines a multitude of image signals to create a compound image, The system has a plurality of memory modules operative to store the image signals as pixels for the compound image as respective segments of consecutive pixels. A specific row of consecutive pixels of the compound image is formed by consecutive arrangement of the respective segments. This permits the use of a simple addressing protocol, and of simple page-mode access DRAMs.

11 Claims, 4 Drawing Sheets

WINDOW-BASED MEMORY ARCHITECTURE FOR IMAGE COMPILATION

This is a continuation of application Ser. No. 08/483,918, filed Jun. 7, 1995, now abandoned, which is a continuation of application Ser. No. 08/219,129 filed Mar. 29, 1994, now abandoned.

FIELD OF THE INVENTION

The invention concerns an image processing system for combining a multitude of image data streams to create a compound image. The system comprises a plurality of memory modules being operative in combination to store the image data as pixels for the compound image.

BACKGROUND ART

U.S. Pat. No. 5,068,650 discloses such an image processing system using a window compilation technique to combine image data from a plurality of sources, e.g., video data and still image data including text and computer-generated graphics. Multi-media integration typically requires large numbers of high-bandwidth memories to implement multiple-window processing functions for full-motion video images (e.g., multiple-source gen-lock, variable scaling variable positioning, and scan rate conversion) and high-resolution animated graphics (e.g., α-channelling, block moving, multiple-windowing), all in real-time. The aforesaid prior art discloses a multi-ported high-performance memory system. Each independent memory port provides random access to addressed memory locations.

The memory system of the prior art stores the data according to an interleaving strategy on a pixel-to-pixel basis. In order to establish a pattern of overlapping windows, it is necessary to write, into the memory, the data that will be displayed in the windows defined by the pattern. To this end, a key is assigned to each pixel location of the memory system. A particular key represents a particular one of a plurality of overlapping windows making up the compound image. Each pixel to be written contains key data, corresponding to the window within which it is intended to be displayed. The key data serves to gain access to an addressed location within the specific window corresponding to the actual key data. The key-based memory access thus provides a unified approach to determine which pixels of the incoming image data are written into the memory system at particular memory locations to properly reflect visibility of a predetermined pattern of windows.

The prior art memory system contains 16 memory modules. Pixels from consecutive columns of a line in the eventual compound image are stored in consecutive memory modules in a round robin fashion. Accordingly, the clock controlling the operation of an individual memory module is lowered by a factor of 16 with regard to the basic clock for the operation of the memory system as a whole.

OBJECT OF THE INVENTION

The prior art reduces the clock frequency per module by use of a memory bank strategy on a pixel-to-pixel interleaving basis. This requires both a memory module selection cycle and a complete memory access cycle, i.e., both row access and column access, to be executed for each pixel individually. Consequently, a substantial portion of the access bandwidth of the system as a whole is spent on the mere addressing. Further, the mapping of the pixels, as cyclically allocated among the memory modules in the manner discussed above, onto the screen coordinates of the compound image requires a complicated controller and a rotating shuffle network to route each individual pixel in a stream of video data to different ones among the memory modules.

It is therefore an object of the invention to provide a system as mentioned in the preamble that is fast, that has a modular architecture, that is considerably simpler to assemble or to extend and that uses simpler hardware and routing than the known system.

SUMMARY OF THE INVENTION

To this end, the invention furnishes a system as specified in the preamble and characterized in that respective ones of the modules are operative to store respective segments of consecutive pixels, and in that the system is operative to create a specific row of consecutive pixels of the compound image by consecutive arrangement of the respective segments.

The invention is based on the segmentation of a row (video line) of consecutive pixels for the compound image into two or more segments of consecutive pixels, each respective one of the segments being handled by a respective one of the memory modules. Each particular one of the modules corresponds to a particular coherent segment of consecutive pixels. Accordingly, there is a simple relationship between the addresses of the pixels as stored in the modules and the locations of the pixels in the compound image.

In particular, the line segmentation allows for the use of relatively cheap DRAMs as memory modules, preferably with page-mode access to allow for fast addressing of pixels of a same row (video line). In a DRAM, access of each cell is accomplished by providing the associated row address and column address. An address strobe latches each of the addresses into the DRAM's internal registers for subsequent decoding. Both row address and column address share the same input lines, so the DRAM requires two distinct strobes to identify which of the addresses is presented. These strobes are called the row-address strobe (RAS) and the column address strobe (CAS), whose relative timing governs DRAM operation. A DRAM having a page-mode access permits accessing any number of cells of the same row with only one application of the row address. Keeping RAS valid, subsequent accesses are accomplished by strobing-in the appropriate column addresses. Thus, RAS cycles are avoided as long as cells of a single row are involved.

A complete video line of the compound image thus is divided among a plurality of memory modules. If two or more streams of image data are available for being written into the same module, one of them can be written directly, the other needs to be buffered at least for the duration of the time required for writing the first one into the relevant module.

The system may further comprise input means for receiving the streams of image data; bus means coupled between the input means and the memory modules for routing of the image data; output means coupled to the bus means for supply of the respective segments upon reading of the memory modules; and buffer means for storing the image data prior to supplying the image data to the memory modules, coupled at least between the input means and the bus means or between the bus means and the memory modules. The input means preferably comprises a multitude of input ports, and the buffer means preferably comprises a multitude of buffers, each respective one being coupled between a respective one of the input ports and the bus means, or between the bus means and a respective one of the memory modules. Such an approach supports a modular architecture. The memory modules have operation cycles overlapping in time. That is, a specific memory module is read while other modules are being written or read at the same time. The system functions in such a way that the respective rows of pixels in the respective modules together form a row of pixels of the compound image. As a consequence, the size of the buffers can be reduced to the characteristic size of the line segment.

The invention thus provides a memory architecture that is simpler than that of the prior art and that nevertheless allows for use with a multiple-window video/graphics image compilation technique while maintaining high access-bandwidth. Further details are discussed below.

BRIEF DESCRIPTION OF THE DRAWING

The invention is explained below by way of example and with reference to the accompanying drawing wherein.

The same reference numerals are used throughout the drawing to indicate corresponding or similar features.

System Architecture

Figure 1:
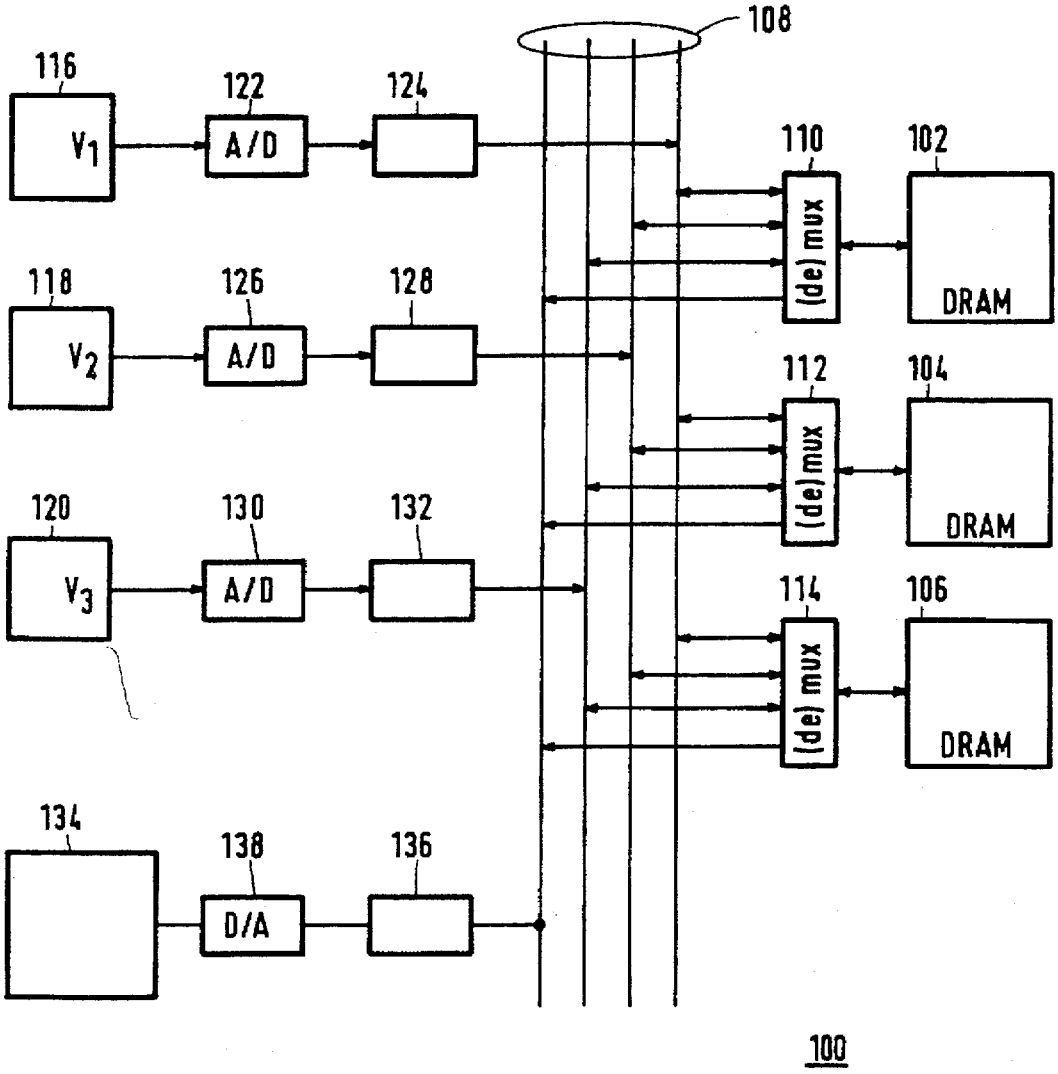
FIG. 1 is an example of a system in the invention.

FIG. 1 gives an example of the system 100 of the invention for handling streams V1, V2 and V3 of image signals that are synthesized to form a compound image using a window protocol. Signals V1–V3 are, for instance, TV signals transmitted by three different broadcasting stations (not shown), or two video signals supplied by video signal storage devices (not shown) and a TV signal. It is assumed that signals V1–V3 are generated on the basis of a raster scan technique, i.e., V1–V3 are supplied as sequences of consecutive pixels of consecutive video lines. Signals V1–V3 need not be synchronous to one another or to a system clock. It is assumed that V1–V3 are available simultaneously and are to be combined on a real-time basis for display in respective window areas.

System 100 comprises memory modules 102, 104 and 106 that are coupled to a data bus 108 via (de)multiplexers 110, 112 and 114, respectively. Memory modules 102–106 each may comprise a DRAM device. A first video source 116 supplies video signal V1, a second video source 118 supplies video signal V2, and a third video source 120 supplies video signal V3. Source 116 is coupled to bus 108 via an A/D converter 122 and an input buffer 124. Source 118 is coupled to bus 108 via an A/D converter 126 and an input buffer 128. Source 120 is coupled to bus 108 via an A/D converter 130 and an input buffer 132. System 100 further includes a monitor 134 for display of the compound image. Monitor 134 receives its compound signal from modules 102–106 via (de)multiplexers 110–114, bus 108 and via an output buffer 136 and a D/A converter 138. If the read-out time intervals of modules 102–106 are contiguous, output buffer 136 can be dispensed with.

Each of sources 116–120 is coupled to bus 108 through a respective one of input buffers 124, 128 and 132 to ensure that subsequent references to the same one of modules 102–106 can be buffered. Each of modules 102–106 handles a particular one of (in this example) three horizontally contiguous field segments making up the compound image to be displayed by monitor 134. Each row of pixels of the compound image is a concatenation of line segments that each are handled by different ones of modules 102–106. This approach requires all memory accesses to be scheduled in time slots of a sufficiently long length, such that the average access-cycle rate can be maximized by minimizing the number of row (page) switches in the relevant DRAMs. The scheduling is discussed with reference to FIGS. 2–7.

Each of memory modules 102–106, (de)multiplexers 110–114 and buffers 124, 128 and 132 is controlled, e.g., by an individual controller (not shown). Such a controller then includes an event table, next-event logic circuitry and an address calculation unit. A particular event table stores information about the outlines of a particular window to be displayed in the compound image, and about intersections with other windows as vertical events and horizontal events, as is discussed below. The size of these tables depends on the number of windows being displayed in the compound image, the shapes of the windows, and on the number of memory modules used. The next-event circuitry and the address calculation unit can be implemented by simple logic circuits such as comparators, counters, adders and subtractors.

Note that (de)multiplexers 110–114 could have been arranged between input buffers 124, 128 and 132 on the one hand and bus 108 on the other hand instead of between modules 102-106 and bus 108.

Scheduling

FIGS. 2–7 illustrate the image compilation and the scheduling of access requests to memory modules 102–106. It is assumed that compound image 200 contains three windows 202, 204 and 206, each respective one to accommodate images stemming from a respective one of sources 116–120. It is further assumed that the pixel array corresponding to compound image 200 is comprised of, in this example, three field segments 208, 210 and 212 that are handled by memory modules 102, 104 and 106, respectively. For ease of explanation, it is further assumed that video sources 116–120 provide video information of a uniform video format.

Figure 2:
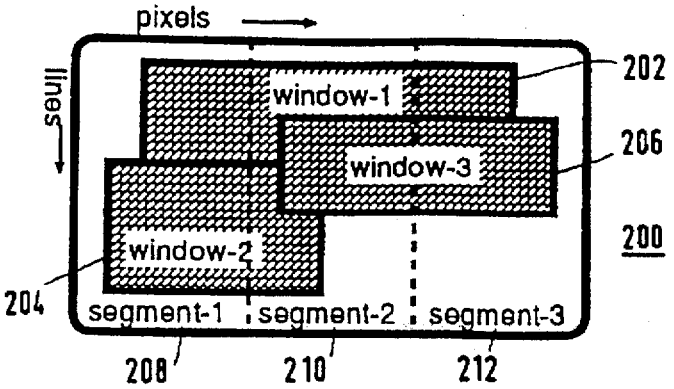
FIGS. 2–9 illustrate the compilation of a multi-window image and the scheduling of access requests to the memory modules.
Figure 3:
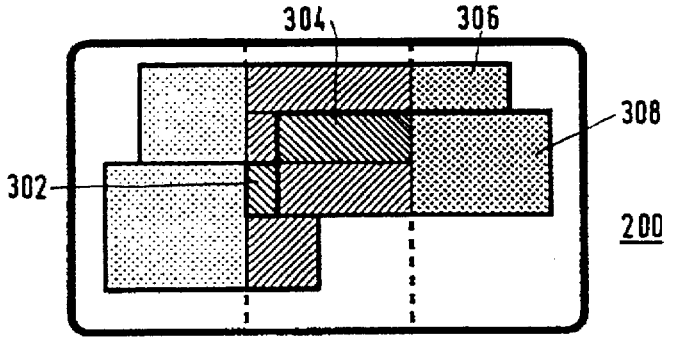

FIG. 2 shows the geometrical window configuration in compound image 200. All window boundaries made to intersect with one another so that rectangular areas can be computed that contain a portion of a single one of windows 202–206 within a single one of field segments 208–212 only. The locations of the rectangular areas relative to one another indicate the moments in time that are relevant to the switching among the modules as is explained below. FIG. 3 identifies some of these areas, e.g., areas 302, 304, 306 and 308.

Figure 4:
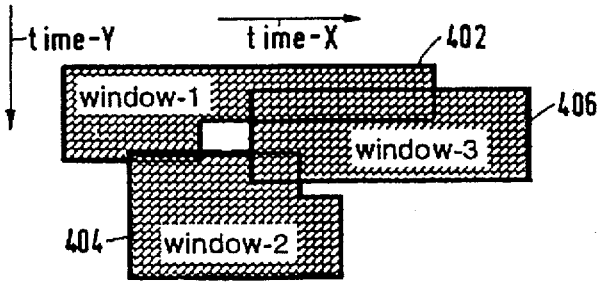
Figure 5:
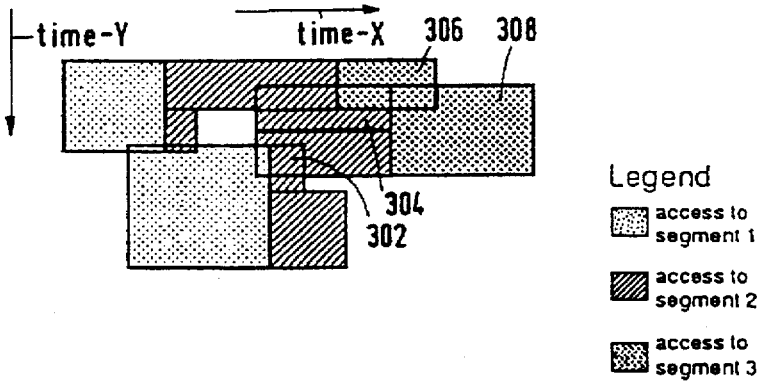

FIG. 4 illustrates the time frame wherein information for the visible parts of windows 202–206 in the compound image is entering input buffers 124–132. The horizontal time-X runs from left to right and relates to a single video line in the uniformly formatted images supplied by sources 116–120. The time-X indicates the number of clock cycles elapsed since the start of the video line. The time-Y runs from top to bottom and indicates the number of video lines elapsed since the start of a single image field, again related to the uniformly formatted video information supplied by sources 116–120. So, the temporal interrelationship in FIG. 4 is represented in line and pixel coordinates. Each respective one of windows 402, 404 and 406 in FIG. 4 corresponds to the information to be presented in compound image 200 in window 202, 204 and 206, respectively, but is shown in temporal relationship with others as presented at the input of input buffers 124–132. Note the overlap in time of the windows 402–406 at the entry of the input buffers. FIG. 5 shows the partitioning into the rectangles according to FIG. 3, now represented in the temporal interrelationship according to FIG. 4.

Figure 6:
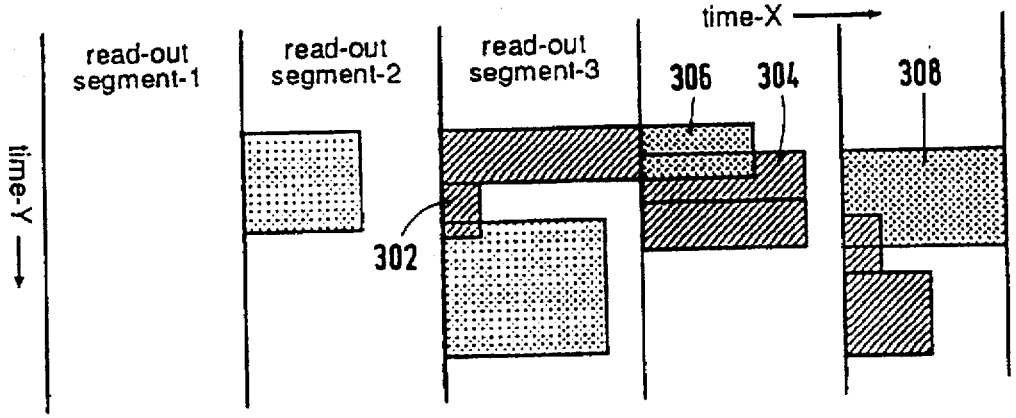

The rectangles shown in FIG. 5 are shifted in the horizontal direction, i.e., the direction corresponding to the time-X, in such a way that no overlap remains between rectangles which should be written to the same one of field segments 208–212, or, in other words, that no access conflicts will take place as a consequence of temporally overlapping access requests to a single one of memory modules 102–106. FIG. 6 shows the thus shifted rectangles. Shifting is allowed only in this direction so that input buffers 124, 128 and 132 that implement these shifts have a storage capacity between a few pixels and a complete video line. Shifting in the vertical direction would require buffers 124, 128 and 132 to have a storage capacity between a few lines and a complete video field.

Figure 7:
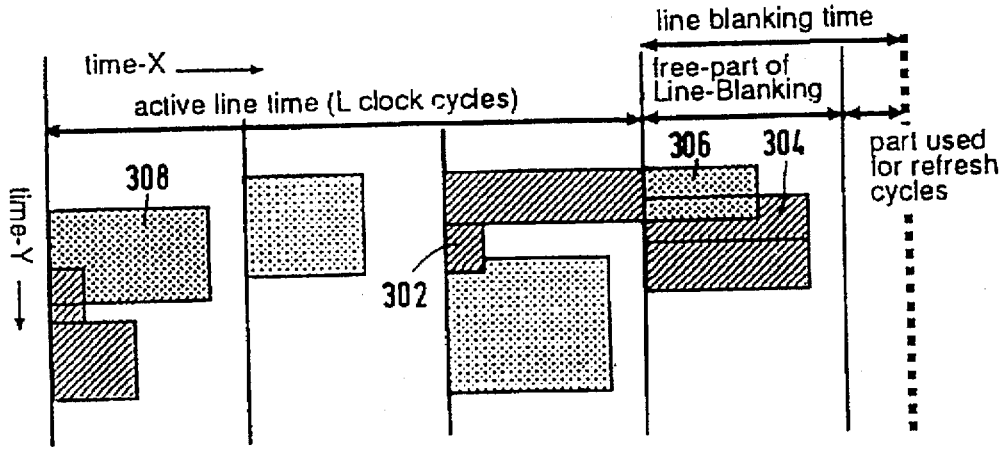

The shifts that extend beyond the line blanking period, such as for rectangular area 308, are folded to the next line period. This is shown in FIG. 7. The number of concurrent video input/output signals can be increased until it becomes impossible to avoid overlap. A sufficiently long blanking period or a sufficiently large number of field segments (or memory modules) permits reading or writing additional pixels from or to memory modules 102–106, respectively. Any free time can be used for, e.g., the graphics processor (not shown) to update the display memory (not shown) of monitor 134. Note that the scheduling in the system of the invention minimizes usage of bus 108 and maximizes the free time for a graphics processor to, e.g., access memory modules 102–106 or the display memory of monitor 134.

Figure 8:
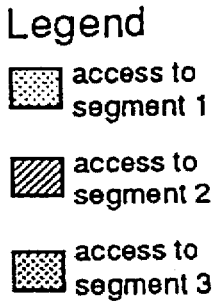

FIG. 8 shows a legend and merely is for ease of understanding FIGS. 6 and 7. The read requests can be scheduled in such a way as to read memory modules 102–106 in the raster-scan fashion of video signals so that output buffering can be omitted. The time-folding thus accomplished can be translated easily into horizontal and vertical events as a basis for the controllers of DRAMs 102–106, buffers 124, 128 and 132, and bus 108. Note that the horizontal and vertical events can be translated into a two-dimensional run-length code (pixels and lines), since a line segment of a video line in compound image 200 that corresponds to a particular one of windows 202–206 consists of consecutive pixels.

Assume that system 100 comprises a number of M memory modules 202, 204, 206, . . . . Further assume that each module is a DRAM that is sufficiently fast to accommodate f concurrent or effectively concurrent video data. For currently available conventional page-mode DRAMs f equals unity: f=1. For special types like synchronous DRAMs f equals 3 or 4: f=3 or f=4. Then, M modules can handle a number of fM video input or output signals. Suppose that compound image 200 accommodates a number of N input signals V1, V2, V3, . . . in N windows. Accordingly, there is a need for N+1 I/O channels. Now, equating fM and N+1 implies that M modules can handle N=fM−1 channels. However, since the line blanking time period can be used to access the memory modules, the number N of input signals can be larger than fM−1, e.g., N=fM as in the example explained above. In case of processing images of reduced size, extra bandwidth becomes available to handle an even higher number of windows.

Input buffers

A complete video line of L pixels in compound image 200, made up of a number of N image signals (video signals) V1–V3, is divided among a plurality M of memory modules as described above. N is equal to 3 and M is equal to 3 in above example. Assume that two or more streams of image data are simultaneously available for being written into the same module, one of them can be written directly, the other needs to be buffered at least for the duration of the time required for writing the first one into the relevant field segment. This applies for example, to field segment 208 simultaneously displaying portions of windows 202 and 204, and to field segment 210 that simultaneously displays portions of windows 202, 204 and 206 a shown in FIG. 2. Accordingly, additional storage capacity is needed and is provided by input buffers 124, 128 and 132.

A memory module to which no access is requested could in principle be used as a temporary buffer. However, this would considerably complicate scheduling of memory and routing operations. In addition, use of a DRAM module as temporary buffer would need additional addressing in contrast to directly accessible separate buffers, thereby rendering the use of the DRAM module as temporary buffer not feasible. As a consequence, separate input buffers are used.

Input buffers 124, 128 and 132 store data from video sources 116, 118 and 120 from the first pixel of each video line (t=0) of the compound image until the relevant one of modules 102–106 (or of field segments 208–212) becomes available. Additional buffer capacity is needed to store video data during the time that a new row address for the relevant DRAM module(s) must be set up. The number of clock cycles to set up a row address is denoted by R. Accordingly, R clock cycles from the start of a video line a row address for first field segment 208 is set up to read-out the first 1/M-th part (M=3) of a video line while new video data is being written to input buffers 124, 128 and 132.

Let L denote the number of clock cycles (or pixels) per line of compound image 200. Then, the set up of the row address for the writing of first field segment 208 is done after R+L/M clock cycles. Therefore, writing of first field segment 208 with the first 1/M-th part of the video line stored in buffer 124 starts at 2R+L/M clock cycles from the beginning of the video line and terminates at the start of clock cycle 2R+2L/M. Second input buffer 128 can be flushed to first field segment 208 after first input buffer 124 has finished writing to field segment 208 and after an additional row-address set-up time has elapsed, i.e., at clock cycle 3R+2L/M.

Generally, buffer 124, 128 and 134 can flush data to first field segment 208 in the time intervals: 2R+L/M–2R+2L/M; 3R+2L/M–3R+3L/M; and 4R+3L/M–4R+4L/M, respectively.

The read-out of second field segment 2 10 starts at clock cycle R+L/M, hence flushing of data from buffer 124 can start at cycle 2R+2L/M. In general, input buffers 124, 128 and 132 can flush data to second field segment 210 in the time intervals: 2R+2L/M–3R+2L/M; 3R+3L/M–3R+4L/M; and 4R+4L/M–4R+5L/M, respectively.

As a conclusion, for field segment Sj, wherein j=1, 2, . . . , M, read-out starts at clock cycle R+(j−1)L/M and terminates at R+jL/M. Flushing of input buffers Bi, wherein i=1, 2, . . . , N, to field segment Sj starts at (i+1)R+(i+j−1)L/M and terminates at (i+1)R+(i+j)L/M. Note that this is one out of a plurality of possible scheduling implementations.

Figure 9:
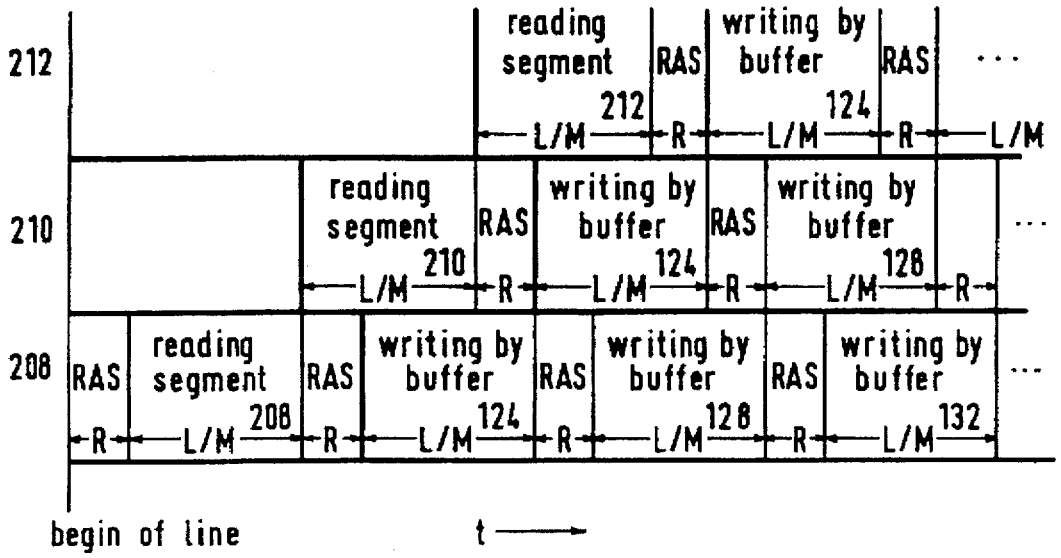

FIG. 9 illustrates the above relationships for a worst case scenario, showing the time intervals required to handle various events for each of field segments 208–212 (modules 102–106), and buffers 124, 128 and 132. From FIG. 9 it is clear that an operative distribution of buffer capacity can be obtained, e.g., when buffer 124 has a buffer capacity of an amount of data corresponding to 2R+L/M clock cycles, buffer 128 has a buffer capacity corresponding to 3R+2L/M clock cycles, and buffer 132 has a buffer capacity of 4R+3L/M clock cycles.

Overlay Encoding

As mentioned above, run-length encoding is preferably used to encode the overlay for multiple overlapping windows, each relating to a particular one of plurality of image signals. Coordinates of a boundary of a particular window and a number of pixels per video line falling within the boundaries of the particular window are stored. This type of encoding is particularly suitable for video data in raster-scan formats, since it allows sequential retrieval of overlay information from a run-length buffer. Run-length encoding typically decreases memory requirements for overlay-code storage, but typically increases the control complexity.

In case of a one-dimensional run-length encoding, a different set of run-lengths is created for each line of the compound image. For two-dimensional run-length encoding, run-lengths are made for both the horizontal and the vertical directions in the compound image, resulting in a list of horizontal run-lengths that are valid within specific vertical screen intervals. This approach is particular suitable for rectangular windows as is explained below.

A disadvantage associated with this type of encoding resides in a relatively large difference between peak performance and average performance of the controller. On the one hand, fast control generations are needed if events rapidly follow one another, on the other hand the controller is allowed to idle in the absence of the events. To somewhat mitigate this disadvantageous aspect, processing requirements for two-dimensional run-length encoding are reduced by using a small control instruction cache (buffer) that buffers performance peaks in the control flow. The controller in the invention comprises: a run-length encoded event table, a control signal generator for supply of control signals, and a cache memory between an output of the table and an input of the generator to store functionally successive run-length codes retrieved from the table. A minimal-sized buffer stores a small number of commands such that the control state (overlay) generator can run at an average speed. At the same time, the buffer enables the low-level high-speed control-signal generator to handle performance peaks when necessary. An explicit difference is made between low-speed complex overlay (control)-state evaluation and high-speed control-signal generation. This is explained below.

Figure 10:
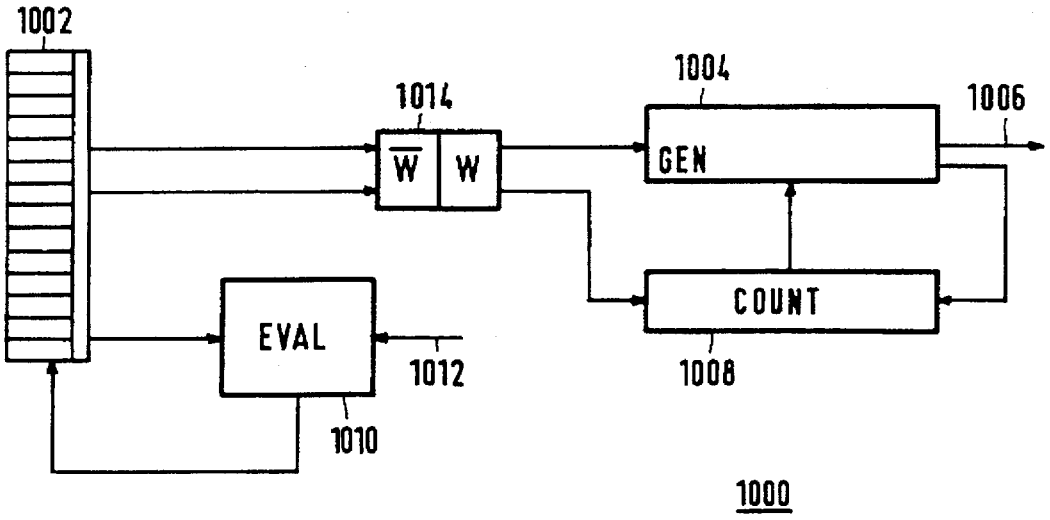
FIG. 10 shows an example of a controller.

FIG. 10 gives an example of a controller 1000 based on run-length encoding. Controller 1000 includes a run-length/event buffer 1002 that includes a table of 2-dimensional run-length encoded events, e.g., boundaries of the visible portions of the windows (events) and the number of pixels and or lines (run-length) between successive events. In the raster-scan format of full-motion video signals, pixels are written consecutively to every next address location in the display memory of monitor 134, from the left to the right of the screen, and lines of pixels follow one another from top to bottom of the screen. Encoding is accomplished, for example, as follows.

The number of line Yb coinciding with a horizontal boundary of a visible portion of a particular rectangular window and first encountered in the raster-scan is listed, together with the number #W0 of consecutive pixels, starting at the left most pixel, that do not belong to the particular window. This fixes the horizontal position of the left hand boundary of the visible portion of the particular window. Each line Yj within the visible portion of the particular window can now be coded by dividing the visible part of line Yj into successive and alternate intervals of pixels that are to be written and are not to be written, thus taking account of overlap. For example, the division may result in a number #W1 of the first consecutive pixels to be written, a number #NW2 of the next consecutive pixels not to be written, a number #W3 of the following consecutive pixels to be written (if any), a number #NW4 of the succeeding pixels not to be written (if any), etc. The last line Yt coinciding with the horizontal boundary of the particular window or of a coherent part thereof and last encountered in the raster scan is listed in the table of buffer 1002 as well.

Buffer 1002 supplies these event codes to a low-level high-speed control generator 1004 that thereupon generates appropriate control signals, e.g., commands (read, write, inhibit) to govern input buffers 124, 128 or 132 or addresses and commands to control memory modules 102–106 or bus access control commands for control of bus 108 via an output 1006. A run-length counter 1008 keeps track of the number of pixels still to go until the next event occurs. When counter 1008 arrives at zero run-length, generator 1004 and counter 1008 must be loaded with a new code and new run-length from buffer 1002.

Due to the raster-scan format of full-motion video signals, pixels are written consecutively to every next address location in the display memory of monitor 134, from the left to the right of the screen, and lines follow one another from top to bottom. A control-state evaluator 1010 keeps track of the current pixel and line in the display memory via an input 1012. Input 1012 receives a pixel address "X" and a line address "Y" of the current location in the display memory. As long as the current Y-value has not reached first horizontal boundary Yb of the visible part of the particular window, no action is triggered and no write or read commands are generated by generator 1004. When the current Y-value reaches Yb, the relevant write and not-write numbers #W and #NW as specified above are retrieved from the table in buffer 1002 for supply to generator 1004 and counter 1008. This is repeated for all Y-values until the last horizontal boundary Yt of the visible rectangular window has been reached. For this reason, the current Y-value at input 1012 has to be compared to the Yt value stored in the table of buffer 1002. When the current Y-value has reached Yt, the handling of the visible portion of the particular window constituted by consecutive lines is terminated. A plurality of values Yb and Yt can be stored for the same particular window, indicating that the particular window extends vertically beyond an overlapping other window. Evaluator 1010 then activates the corresponding new overlay/control state for transmission to generator 1004.

The control state can change very fast if several windows are overlapping one another whose left or right boundaries are closely spaced to one another. For this reason, a small cache 1014 is coupled between buffer 1002 and generator 1004. The cache size can be minimized by choosing a minimal width for a window. The minimal window size can be chosen such that there is a large distance (in the number of pixels) between the extreme edges of a window gap, i.e., the part of a window being invisible due to the overlap by another window. Now, if a local low-speed control-state evaluator 1010 is used for each I/O buffer 124, 128, 132 and 136 or for each memory module 102–106, then the transfer of commands should occur during the invisible part of the window, i.e., during its being overlapped by another window. As a result, the duration of the transfer time-interval is maximized this way. The interval is at least equal to the number of clock cycles required to write a window having a minimal width. Two commands are transferred to the cache: one giving the run-length of the visible part of the window (shortest run-length) that starts when the current run-length is terminated, and one giving the run-length of the subsequent invisible part of the same window (longest run-length). The use of cache 1014 thus renders controller 1000 suitable to meet the peak performance requirements.

We claim:

1. A method for creating a row of pixels for a compound image, which compound image includes a plurality of components, each respective one of the components originating from a respective one of a plurality of data streams, the method comprising:

a) receiving the plurality of data streams;

b) allocating the compound image into a plurality of segments, each respective one of the segments comprising a respective one of contiguous regions of the compound image, and each respective one of the segments corresponding to a respective one of a plurality of memory modules;

c) within each segment, grouping image data according to components to create groups of contiguous pixels, each respective one of the groups containing data from only a respective one of the segments and from only a respective one of the data streams;

d) creating a row of pixels in the memory modules, which creating comprises the following steps with respect to a particular one of the memory modules:

i) storing a first portion of a first group of pixels in the particular one of the memory modules, which first group corresponds to the segment corresponding to the particular one of the memory modules, and which first portion consists of consecutive pixels; and ii) buffering a second portion of a second group of pixels, which second group is destined for the same segment as the first group but comes from a component different from the first group of pixels, which second portion also consists of consecutive pixels, the buffering being at least as long as the write time for the first portion, so that writing the second portion does not overlap with writing the first portion; and iii) subsequent to the buffering, storing the second group in the particular one of the memory modules;

e) reading the row from the plurality of memory modules.

2. The method of claim 1 wherein each component is to be displayed as a respective window in the compound image.

3. The method of claim 2 wherein at least one of the respective windows extends over more than one of the segments.

4. The method of claim 3 wherein the image has a shape which is at least approximately rectangular.

5. The method of claim 4 wherein each of the segments is at least approximately rectangular.

6. The method of claim 5 wherein the grouping step comprises extending window boundaries so that the extended boundaries intersect; and determining rectangular portions within the extended boundaries, each rectangular portion containing data from only a respective one of the windows and a respective one of the segments, which rectangular portions are the groups.

7. The method of claim 6 wherein the portion of the first group is written to the respective memory module after an elapsed time of 2R+L/M, where R is the read address set up time; L is the number of clock cycles per line of compound image; and M is the number of memory modules; and the portion of the second group is written to the respective memory module after an elapsed time of 3R+2L/M.

8. An image processing system for creating a row of pixels for a compound image from a plurality of image components, wherein:

each respective one of the image components originates from a respective one of a plurality of image data streams;

the system comprises:

input means for receiving the respective one of the data streams;

a plurality of memory modules coupled to the input means;

buffer means between the input means and the memory modules;

each respective one of the memory modules stores a respective one of a plurality of image segments;

each respective image segment comprises a respective one of contiguous regions of the compound image;

the system is operative to group, within each respective image segment, image data according to components to create groups of contiguous pixels, each group contains data from only a respective one of the image segments and from only a respective one of the data streams;

the system controls the buffer means and each particular one of the memory modules, so that for each particular memory module:

a first portion of a first group of consecutive pixels is stored in the particular memory module, which first group corresponds to the image segment associated with the particular memory module;

a second portion of a second group of consecutive pixels is buffered in the buffer means, which second group is destined for the image segment associated with the particular memory module, the first and second groups coming from different ones of the components, and the buffering being at least as long as a write time for the first portion, so that writing the second portion does not overlap with writing the first portion; and the second group is stored in the particular module subsequent to the buffering.

9. The system of claim 8, wherein each respective one of the memory modules comprises a respective DRAM having a page mode.

10. The system of claim 8, wherein:

the input means comprises a plurality of input ports;

the buffer means comprises a plurality of buffers;

the system comprises a bus means for interconnecting a specific one of the input ports and a specific one of the memory modules via a specific one of the buffers.

11. The system of claim 10, wherein:

the system comprises control means for control of the memory modules and the buffers;

the control means comprises:

a run-length encoded event table with a table output to provide run length codes;

a control signal generator with a generator input for receiving a run length code and with a generator output for supplying a control signal in response to the run length code;

a cache memory between the table output and the generator input for storing functionally successive run length codes retrieved from the event table.

* * * * *